United States Patent [19]

Speelman

[11] Patent Number: 4,501,561

[45] Date of Patent: Feb. 26, 1985

[54] BRACE DEVICE FOR MOTOR BOAT DRIVE UNIT

[76] Inventor: Paul G. Speelman, 319 Old St. Rd., Clarksville, Ohio 45133

[21] Appl. No.: 513,717

[22] Filed: Jul. 14, 1983

[51] Int. Cl.[3] ..... B63H 5/12

[52] U.S. Cl. ..... 440/61; 248/351; 248/354.5; 248/640

[58] Field of Search ..... 440/53, 61; 248/640, 248/641, 642, 643, 351, 354 R, 354 P, 503; 280/414.1; 114/343, 364

[56] References Cited

U.S. PATENT DOCUMENTS

| | | | |
|---|---|---|---|
| 2,901,267 | 8/1959 | Holsclaw | 248/642 |
| 2,939,670 | 6/1960 | Anderson | 248/351 |
| 2,977,084 | 3/1961 | Brown et al. | 248/351 |
| 3,018,989 | 1/1962 | Gossett | 440/53 |
| 3,111,929 | 11/1963 | Fisher | 248/641 |
| 3,583,357 | 6/1971 | Shimanckas | 440/61 |
| 3,693,576 | 9/1972 | Driscoll | 248/642 |
| 3,941,344 | 3/1976 | Paterson | 248/642 |
| 3,952,986 | 4/1976 | Wells | 248/642 |
| 4,086,869 | 5/1978 | Woodruff | 440/61 |
| 4,125,236 | 11/1978 | Landwerlen | 248/4 |
| 4,227,480 | 10/1980 | Carras | 248/642 |
| 4,331,431 | 5/1982 | Estes | 440/53 |
| 4,391,592 | 7/1983 | Hondertmark | 440/53 |

*Primary Examiner*—Sherman D. Basinger
*Attorney, Agent, or Firm*—Jacox & Meckstroth

[57] ABSTRACT

A brace device for the outboard drive assembly of an inboard/outboard marine propulsion unit. The brace device is a rigid member preferably having all parts integral. The safety brace includes an elongate rod which has a bifurcated portion at each end thereof. One bifurcated portion engages the shaft which supports the hydraulic operators which tilt the outboard drive unit, and the other bifurcated portion engages the forward part of the outboard drive unit. The bifurcated portions are shaped to properly engage the shaft and the forward part of the outboard drive unit.

4 Claims, 6 Drawing Figures

FIG-5
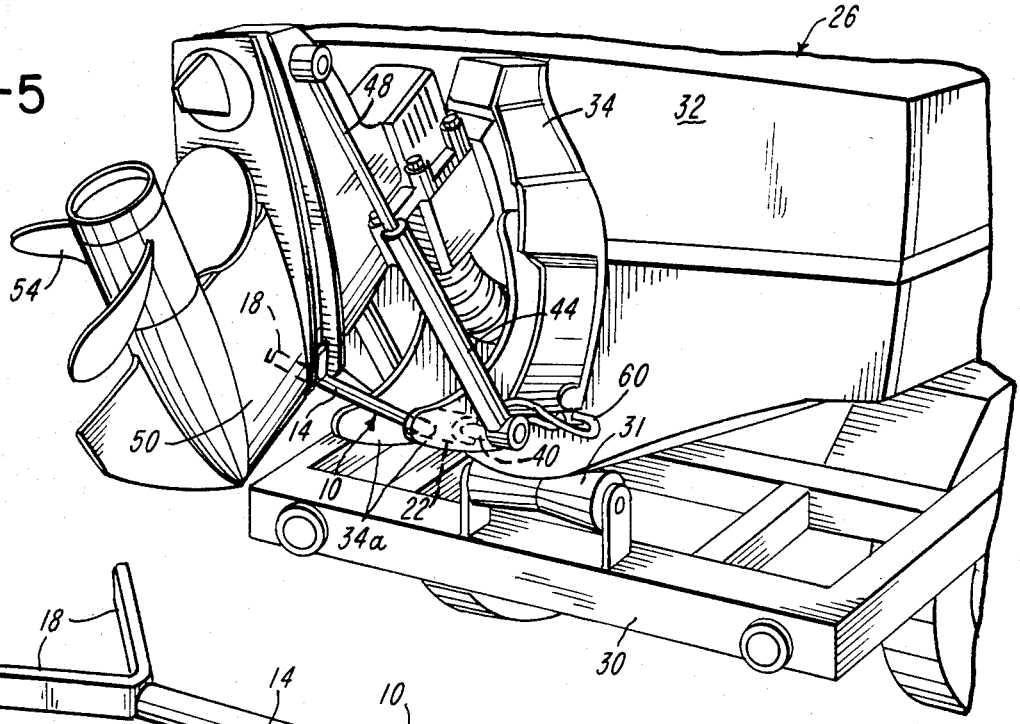
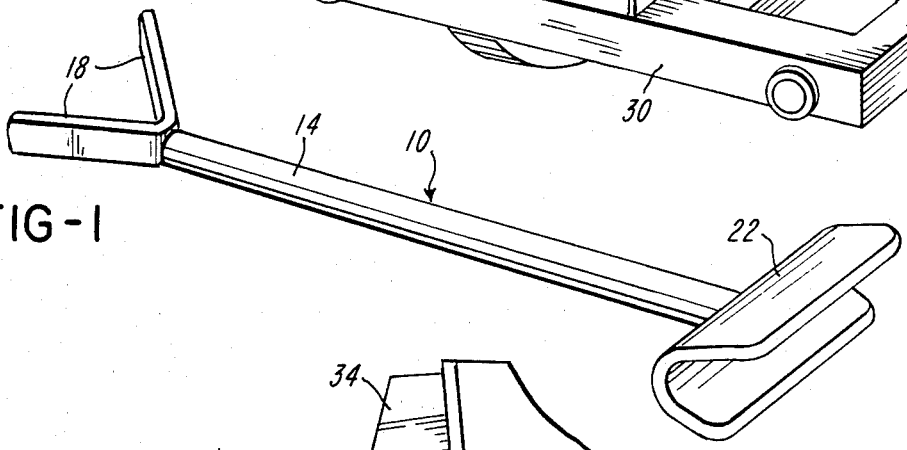
FIG-1
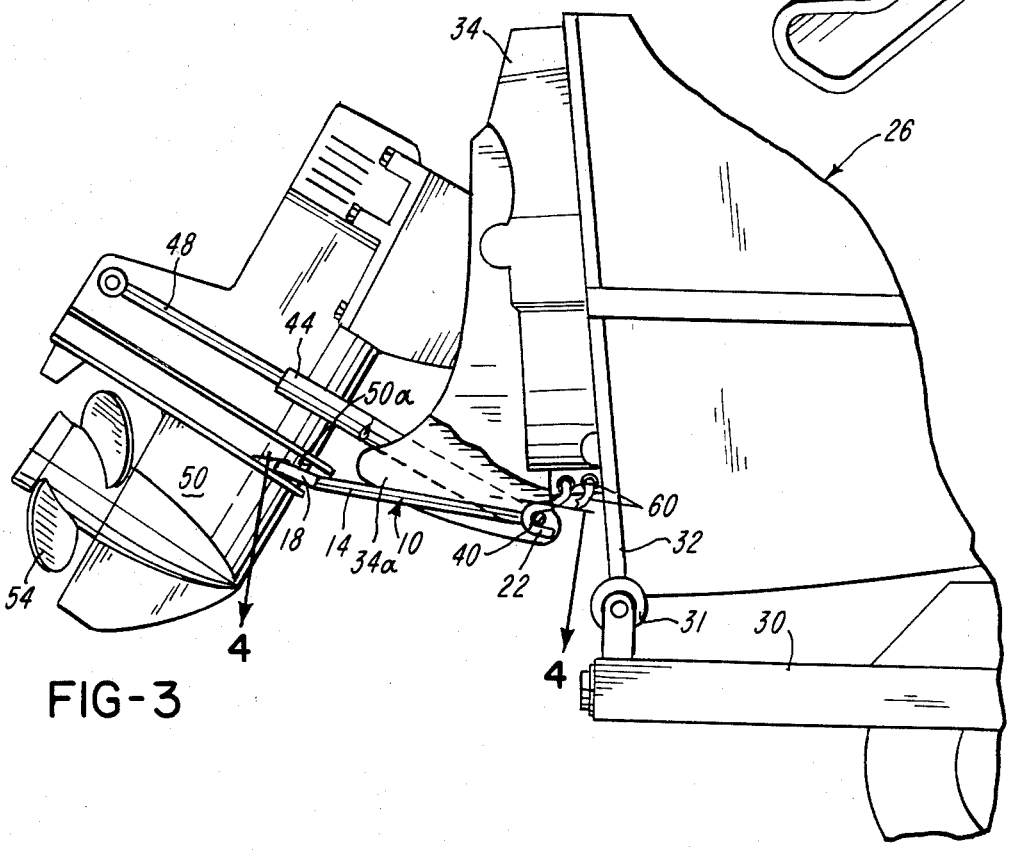
FIG-3

BRACE DEVICE FOR MOTOR BOAT DRIVE UNIT

BACKGROUND OF THE INVENTION

When a motor boat which has an outboard drive unit, such as an inboard/outboard motor boat, is transported by means of a trailer or the like, it is necessary to maintain the outboard drive unit in a tilted-up position, in order to avoid damage to the drive unit.

Devices are employed which engage the drive unit to retain the outboard drive unit in a tilted condition. Some of these devices are tension devices which attach to the device unit and to another element. Also in the prior art, rigid brace members have been employed which engage the trailer and the drive unit or which engage the drive unit and the transom of the boat.

The following show prior art devices for retaining a boat propeller drive unit in a tilted-up position: Holsclaw U.S. Pat. No. 2,901,267, dated Aug. 25, 1959; Anderson U.S. Pat. No. 2,939,670, dated June 7, 1960; Driscoll U.S. Pat. No. 3,693,576, dated Sept. 26, 1972; Patterson U.S. Pat. No. 3,941,344, dated Mar. 2, 1976; Wells U.S. Pat. No. 3,952,986, dated Apr. 27, 1976; Saver U.S. Pat. No. 4,125,236, dated Nov. 14, 1978; Espes U.S. Pat. No. 4,331,431, dated May 25, 1982.

Devices of the type disclosed in the aforementioned patents have not proven satisfactory due to the fact that the trailer is one of the elements engaged by the device. This condition is objectionable due to the fact that relative movement between the boat and the trailer during travel creates a strain between the boat and the drive unit.

Another prior art patent is Brown et al, U.S. Pat. No. 2,977,084, dated Mar. 28, 1961. This patent shows a brace element between the transom of the boat and the propeller drive unit. Such a connection is objectional due to the fact that relative movement between the boat and the drive unit may occur, and such movement creates a strain on the drive unit.

Other known safety devices are employed which rely upon tension forces, rather than compression forces, in retaining the outboard drive unit in the tilted "up" position. For example, in one known device a strap with a hook on each end thereof is connected to the drive shaft housing and to the propeller drive unit. Such devices are not satisfactory in that forces which tend to tilt the drive unit downwardly also tend to straighten out the hooks on the ends of the strap. The hooks release when they approach a straight condition.

It is accordingly an object of this invention to overcome the deficiencies in known devices for retaining a boat propeller drive unit in a tilted-up position and to provide a retention device for a propeller drive unit in which there is a positive firm force to maintain the propeller drive unit in a tilted-up position.

It is another object of this invention to provide a novel retention device for a boat propeller drive unit, such as for an inboard/outboard propeller drive unit, which is a single sturdy, rigid device, and which is easily and readily placed into proper position for use.

Another object of this invention is to provide such a retention device which can be produced at relatively low costs and which is long-lived.

Other objects and advantages of this invention reside in the construction of parts, the combination thereof, the method of production, and the mode of operation, as will become more apparent from the following description.

BRIEF DESCRIPTION OF THE DRAWINGS

FIG. 1 is a perspective view of a brace device of this invention.

FIG. 3 is a side elevational view, with parts broken away, drawn on a slightly smaller scale than FIG. 2, showing a brace device in position for retaining a drive unit in a tilted-up position.

FIG. 5 is a perspective view, drawn on substantially the same scale as FIGS. 2 and 3 and showing a brace device of this invention in its working position with respect to a motor boat drive unit.

DETAILED DESCRIPTION OF THE INVENTION

Figure 2:
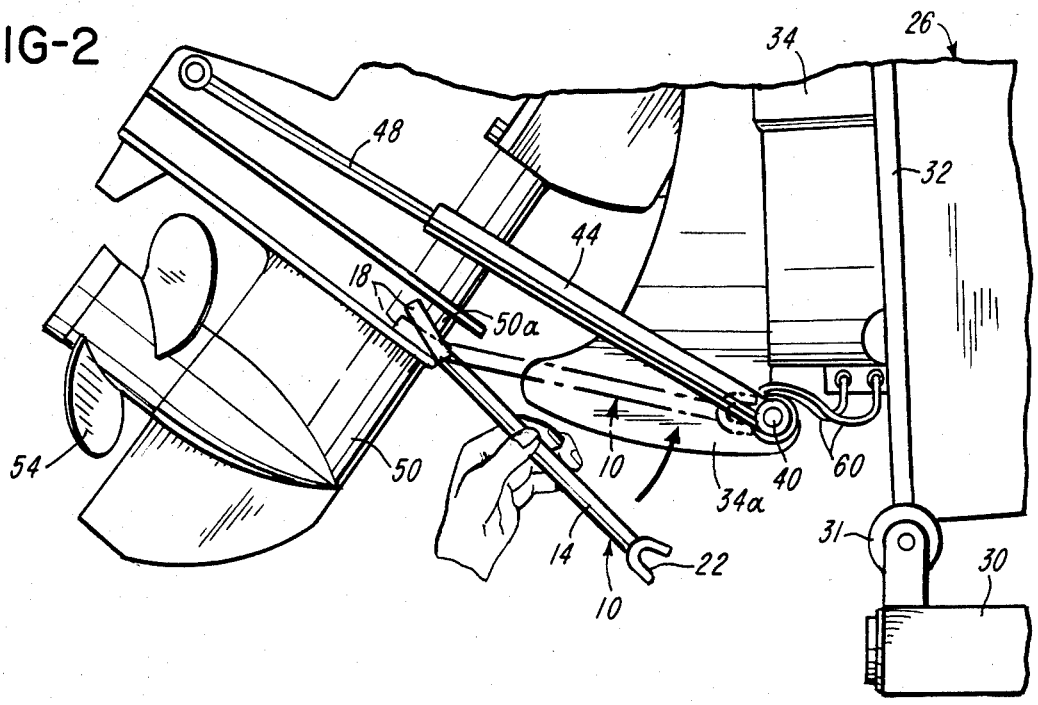
FIG. 2 is a perspective view, drawn on a much smaller scale than FIG. 1, illustrating the method of positioning a brace device of this invention with respect to a propeller drive unit of an inboard-outboard motor boat power assembly.
Figure 4:
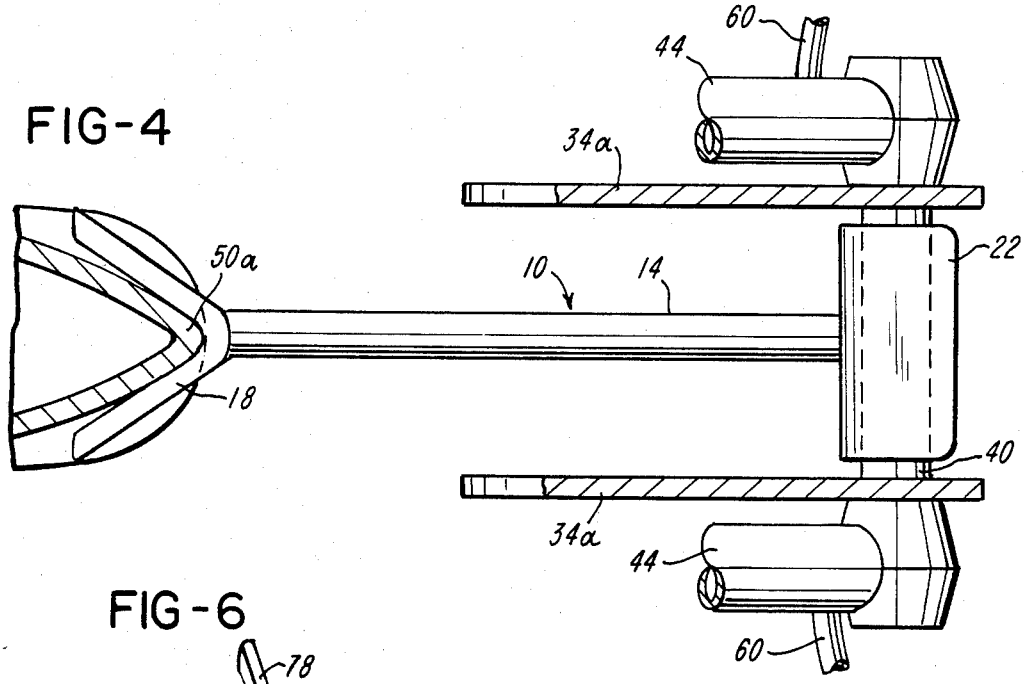
FIG. 4 is a sectional view taken substantially on line 4—4 of FIG. 3 and drawn on a larger scale than FIG. 3.

FIG. 1 shows a brace device 10 of this invention which includes an elongate rod 14. At one end of the elongate rod 14 and integral therewith is a bifurcated engagement portion 18. The bifurcated engagement portion 18 is shown as being generally of a "V" shape. At the other end of the rod 14 and integral therewith is a bifurcated engagement portion 22. The bifurcated engagement portion 22 is shown as being elongate and curved and is shown as being generally of a "U" shape. However the bifurcated engagement portion 22 need not be elongate. As best shown in FIG. 2, the bifuracted portion 18 is at a slight angle with respect to the longitudinal axis of the elongate rod 14.

As illustrated in FIGS. 3 and 5, a brace device 10 of this invention is employed in association with a boat 26 which is supported by a trailer vehicle 30. The stern portion of the boat 26 is shown resting upon a roller 31 of the trailer vehicle 30. The boat 26 has a transom 32 upon which a drive shaft housing 34 is mounted.

At the lower part of the drive shaft housing 34 is a support shaft 40 which is carried by spaced-apart wall members **34*a* of the drive shaft housing 34**.

A pair of hydraulic power cylinders 44 is attached to the support shaft 40, with the wall members **34*a* between the hydraulic power cylinders 44. Each power cylinder 44 has an actuator rod 48 extending therefrom and movable thereby. Each actuator rod 48 is pivotally attached to a propeller drive unit 50, which is provided with a propeller 54**.

When the boat 26 is supported on the trailer vehicle 30 and it is desired to more the boat 26, the hydraulic power cylinders 44 are actuated as fluid is forced thereinto through fluid conduits 60. The drive unit 50 is thus forced to tilt upwardly, as illustrated in FIG. 2. Then a brace device 10 of this invention is moved into position, as illustrated in FIG. 2. The bifurcated portion 18 of the brace device 10 is positioned to engage a tapered forward part **50*a* of the drive unit 50, and the bifurcated portion 22 is positioned to engage the shaft 40 between the wall members 34*a*. Then the hydraulic power cylinders 44 are actuated to permit the drive unit 50 to pivot slightly downwardly. Thus, the brace device 10 is firmly positioned between the shaft 40 and the tapered forward part 50***a* of the drive unit 50, as illustrated.

Thus, the boat 26 can be transported upon the trailer vehicle 30 with the propeller drive unit 50 tilted upwardly and without the possibility of the propeller drive unit 50 moving with respect to the drive shaft housing 34. Thus, the boat 26 is transported with the entire propeller drive unit 50 well above the level of the surface upon which the trailer vehicle 30 travels. Thus, damage to the drive unit 50 or propeller 54 during transit is avoided.

Figure 6:
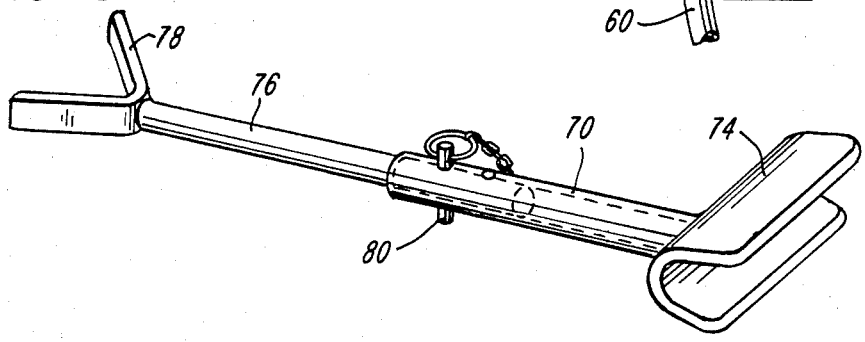
FIG. 6 is a perspective view, drawn on a smaller scale than FIG. 1, showing a modification in a brace device of this invention.

FIG. 6 shows a modification in a brace device of this invention. The brace device of FIG. 6 includes a tubular rigid stem 70 which has a bifurcated end portion 74, which is generally of "U" shape. Within the tubular stem 70 is a rigid solid rod 76 which has a bifurcated end portion 78, which is generally of a "V" shape. The solid rod 76 is axially adjustable within the tubular stem 70, and a pin 80 which extends through the tubular stem 70 and the rod 76 secures the relative positions thereof. Thus, the spacing between the bifurcated end portion 76 and the bifurcated end portion 78 is adjustable.

Although the preferred embodiment of the brace device of the invention has been described, it will be understood that within the purview of this invention various changes may be made in the form, details, proportion and arrangement of parts, the combination thereof, and the manner of use which generally stated consist in a structure within the scope of the appended claims.

I claim:

1. In an inboard/outboard motor boat power assembly including a power drive shaft housing adapted to be mounted on the transom of a boat, a propeller drive unit supported by the housing for pivotal movement between an operative lower position and an inoperative elevated position, a pair of parallel spaced fluid actuated cylinders pivotally connected to the propeller drive unit, a horizontal support shaft extending through a lower portion of the drive shaft housing and pivotally supporting the fluid cylinders, the cylinders being effective to tilt the propeller drive unit between the lower and elevated positions, an improved brace device for supporting the drive unit in the elevated position, comprising an elongate rod, an elongate U-shaped engagement member secured to one end of the rod and disposed perpendicular to the rod, a V-shaped engagement member secured to the opposite end of the rod, the elongate U-shaped member being positioned within the drive shaft housing and releasably seated on the support shaft between the fluid cylinders, and the V-shaped member being releasably engageable with the propeller drive unit when the brace device is positioned between the propeller drive unit and the support shaft to secure the propeller drive unit in the elevated position.

2. In an inboard/outboard motor boat power assembly including a power drive shaft housing adapted to be mounted on the transom of a boat, a propeller drive unit supported by the housing for pivoted movement between an operative lower position and an inoperative elevated position, a pair of parallel spaced fluid actuated cylinders pivotally connected to the propeller drive unit, a horizontal support shaft extending through a lower portion of the drive shaft housing and pivotally supporting the fluid cylinders, the cylinders being effective to tilt the propeller drive unit between the lower and elevated positions, an improved brace device for supporting the drive unit in the elevated position, comprising an elongate rod, an elongate U-shaped engagement member secured to one end of the elongate rod and disposed perpendicular to the elongate rod, a V-shaped engagement member secured to the opposite end of the elongate rod, the V-shaped engagement member being at an angle with respect to the rod, the elongate U-shaped member being positioned within the drive shaft housing the releasably seated on the support shaft between the fluid cylinders, and the V-shaped member being releasably engageable with the propeller drive unit when the brace device is positioned between the propeller drive unit and the support shaft to secure the propeller drive unit in the elevated position.

3. In an inboard/outboard motor boat power assembly including a power drive shaft housing adapted to be mounted on the transom of a boat, a propeller drive unit supported by the housing for pivotal movement between an operative lower position and an inoperative elevated position, a pair of parallel spaced fluid actuated cylinders pivotally connected to the propeller drive unit, a horizontal support shaft extending through a lower portion of the drive shaft housing and pivotally supporting the fluid cylinders, the cylinders being effective to tilt the propeller drive unit between the lower and elevated positions, an improved brace device for supporting the drive unit in the elevated position, comprising an elongate rod, an elongate U-shaped engagement member secured to one end of the elongate rod and disposed perpendicular to the elongate rod, a V-shaped engagement member secured to the opposite end of the elongate rod, the elongate U-shaped member being positioned within the drive shaft housing and releasably seated on the support shaft between the fluid cylinders, and the V-shaped member being releasably engageable with the propeller drive unit when the brace device is positioned between the propeller drive unit and the support shaft to secure the propeller drive unit in the elevated position, the elongate rod being adjustable in length.

4. In an inboard/outboard motor boat power assembly including a power drive shaft housing adapted to be mounted on the transom of a boat, a propeller drive unit supported by the housing for pivotal movement between an operative lower position and an inoperative elevated position, a pair of parallel spaced fluid actuated cylinders pivotally connected to the propeller drive unit, a horizontal support shaft extending through a lower portion of the drive shaft housing and pivotally supporting the fluid cylinders, the cylinders being effective to tilt the propeller drive unit between the lower and elevated positions, an improved brace device for supporting the drive unit in the elevated position, comprising an elongate rod, an elongate U-shaped engagement member secured to one end of the rod and disposed perpendicular to the rod, a V-shaped engagement member secured to the opposite end of the rod, the elongate U-shaped member being positioned within the drive shaft housing and releasably seated on the support shaft between the fluid cylinders, and the V-shaped member being releasably engageable with the propeller drive unit when the brace device is positioned between the propeller drive unit and the support shaft to secure the propeller drive unit in the elevated position, the elongate rod having a first portion and a second portion, the first portion being tubular, the second portion being axially movable within the first portion for adjustment of the length of the brace device.

* * * * *